US006481598B1

(12) United States Patent
Thornsen

(10) Patent No.: US 6,481,598 B1
(45) Date of Patent: Nov. 19, 2002

(54) CONTAINER LINER WITH DISPLACEMENT MEANS FOR AIDING THE DISCHARGE OF THE CONTENTS OF SAID CONTAINER LINER

(75) Inventor: Hans Erik Thornsen, Asnæs (DK)

(73) Assignee: Caretex A/S, Heisingor (DK)

( * ) Notice: Subject to any disclaimer, the term of this patent is extended or adjusted under 35 U.S.C. 154(b) by 0 days.

(21) Appl. No.: 09/585,034

(22) Filed: Jun. 1, 2000

Related U.S. Application Data

(63) Continuation-in-part of application No. 09/501,454, filed on Feb. 10, 2000.

(30) Foreign Application Priority Data

Nov. 18, 1999 (DK) ..... 1999 01662

(51) Int. Cl.[7] ..... B65D 88/00
(52) U.S. Cl. ..... 222/105; 220/1.6
(58) Field of Search ..... 222/92, 105, 183, 222/386.5; 220/1.6

(56) References Cited

U.S. PATENT DOCUMENTS

| | | | | |
|---|---|---|---|---|
| 3,386,605 A | | 6/1968 | Lafont | 220/1.5 |
| 3,904,084 A | * | 9/1975 | Ukmar et al. | 222/105 |
| 3,941,258 A | * | 3/1976 | Ide | 222/386.5 |
| 3,956,839 A | * | 5/1976 | Hermanns | 2222/386.5 |
| 4,673,112 A | * | 6/1987 | Bonerb | 222/386.5 |
| 5,335,820 A | * | 8/1994 | Christianson | 222/386.5 |
| 5,494,394 A | * | 2/1996 | Podd et al. | 222/386.5 |
| 5,626,254 A | | 5/1997 | Podd et al. | 220/1.6 |

FOREIGN PATENT DOCUMENTS

| | | | |
|---|---|---|---|
| EP | 0 338 181 | 10/1989 | |
| WO | WO-9501925 A1 * | 1/1995 | B65D/88/62 |

* cited by examiner

*Primary Examiner*—Henry C. Yuen
*Assistant Examiner*—Patrick Buechner
(74) *Attorney, Agent, or Firm*—Merchant & Gould P.C.

(57) ABSTRACT

The present invention relates to a liner for use in a box-like cargo container for transportation of powder, granular or other flowable products, said liner comprising top and bottom walls, two side walls and first and second end wall portions, a discharge opening at the lower portion of said first end wall through which the contents of the liner are discharged, displacement means for guiding the contents towards said discharge opening, said displacement means comprising at least one inflatable, flexible bag having an essentially triangular or trapezoid shape substantively abutting said first end wall, and a first essentially triangular or trapezoid portion supporting the outside surface of the floor and a second essentially triangular portion supporting the adjacent side wall portion of the liner, said bag comprising three corners positioned substantively at the edge of the end wall and the side wall portion, the end wall and the bottom wall portion, and the side wall and the bottom wall portion. The flexible bags are preferably attached to the outside surface of the liner by a number of individual double adhesive strips, and the upper corner portion of the flexible bag is provided with a flexible inflation tube for inflation of the flexible bag with pressurized air causing the inflation to advance from the upper portion and downwards in the bag as the amount of material in the liner is reduced.

Since an inflatable bag according to the invention has an essentially triangular shape aligned with the end wall and is attached to the liner along the edge of the side wall and the floor of the liner, the material is not lifted but rather pushed sideways away from the side wall of the corner region of the container. The stress implied in the bag as well as in the liner is thereby reduced considerably.

17 Claims, 8 Drawing Sheets

CONTAINER LINER WITH DISPLACEMENT MEANS FOR AIDING THE DISCHARGE OF THE CONTENTS OF SAID CONTAINER LINER

This application is a Continuation-In-Part of U.S. patent application Ser. No. 09/501454, which was filed on Feb. 10, 2000.

BACKGROUND OF THE INVENTION

1. Technical Field

The present invention relates to the unloading of fluid-like or flowable cargo in a container lined with a container liner. In particular, it relates to a container liner with displacement means for moving the contents of the liner towards a discharge opening in the liner.

2. Background Art

Bulk cargo containers are used for transportation of a variety of products. For some products, it is advantageous to fit the container with a flexible liner of e.g. polyethylene or the like. Powered, granular or other flowable materials can be loaded directly from a storage space, such as a silo or the like and into the liner of the container saving a packaging operation by the manufacturer while also making more efficient use of the container space, as packaging materials, such as bags, pallets, etc. do not have to be transported with the products.

The product in the container can subsequently be unloaded and transferred directly into a new storage space with tie recipient. All in all, the whole handling process is considerably easier and a lot less expensive. The product can be discharged from the container liner by tilting the container whereby the powdered, granular or similarly flowable material flows under gravity towards and out of a discharge open at the lower end of the container liner.

However, some of the powdered or granular material is usually trapped in the lower corner regions of the container. In order to move the powdered material towards the discharge, it is known to mount triangular corners, to minimise the likelihood of products accumulating in the corner regions during the discharge operation. An example of such rigid angled corners integrated in a bulkhead is known from U.S. Pat. No. 4,799,607. From U.S. Pat No. 5,531,361, an active bulkhead is known where tetrahedron-shaped inflatable bags are mounted in the lower corners on each side of the discharge. Similarly, inflatable tetrahedrons mounted inside the container liner are known from U.S. Pat. No. 5,489,037.

From international patent application No. WO 95/01925, another solution is known. Here, two inflatable bladders are provided at each lower corner region at the discharge end of the liner.

By these known solutions, the material in the corner regions of the liner is lifted up in the corner region whereby the angle of dip of the material might be exceeded causing the material to slide towards the centre of the container liner. The size of the inflatable corners are relatively restricted due to the design of the corners. Moreover, the lifting of the material in the corners by inflating the corners produces an immense stress in the walls of the corners as well as the walls of the liner itself. This stress is caused by the air pressure in the inflated corner deriving from the pressurised air source filling the corner as well as the load of the material being lifted. This means that the material in the liner just outside the area exposed to impact by the inflating liner could form a dip in the liner creating stress in the liner wall as well.

Such stress can cause the corners or even the liner itself to burst which is unfortunate for obvious reasons as the material is thereby wasted with all the distressing implications associated therewith.

In the above mentioned U.S. Pat. No. 5,531,361, a vibrating mechanism is installed for vibration of the rigid support surface of the corner lifting the liner corner. Hereby, the flow of the material is eased and the discharge flow is enhanced.

However such bulkhead designs take up a lot of space in the container whereby the space for storing the products to be transported is reduced.

It is the object of the invention to provide an improved liner and a method of discharging said liner in such a manner that the above-mentioned drawbacks with the existing liners on the market are avoided.

SUMMARY OF THE INVENTION

This object is achieved by the present invention consisting of a liner for use in a box-like cargo container for transportation of powder, granular or other flowable products, said liner comprising top and bottom walls, two side walls and first and second end wall portions corresponding to the wall portions of the container, a discharge opening at the lower portion of said first end wall, through which the contents of the liner are discharged, displacement means for guiding the content of material towards said discharge opening, said displacement means comprising at least one inflatable, flexible bag having an essentially triangular or trapezoid shape substantively abutting said end first wall, and a first essentially triangular portion supporting the outside surface of the floor and a second essentially triangular portion supporting the adjacent side wall portion of the liner, said triangular bag comprising three corners positioned substantively at the edge of the end wall and the side wall portion, the end wall and the bottom wall portion, and the side wall and the bottom wall portion By the present invention, an inflatable bag is provided that moves the material in the liner sideways towards said discharge opening. An inflatable bag according to the invention has an essentially triangular shape and is aligned with the end wall and is attached to the liner along the edge of the side wall and the floor of the liner. This means that the material is not lifted but pushed sideways away from the side wall of the corner region of the container. The stress implied in the bag as well as in the liner is thereby reduced considerably.

In particular, the upper corner portion of the flexible bag is provided with a flexible inflation tube for inflation of the flexible bag with pressurised air causing the inflation to advance from the upper portion and downwards in the bag as the amount of material in the liner is reduced. This means that the pressurised air in the flexible bag distributes itself in the correct manner causing the material to "roll". The upper portion of the material trapped in the corners at any given time is pushed sideways by the progressing inflation of the bag whereby the angle of dip is exceeded and the material slides down towards the discharge opening. The method and design of the liner relieve the material from excessive stress thus eliminating the risk of overloading and bursting the bags and/or the liner itself during the discharge operation.

In addition, the discharge operation is more efficient since the bags can be designed in considerably larger dimensions without increasing the risk of causing the bag to burst due to excessive internal pressure.

Moreover, by attaching the triangular flexible bags to the outside surface of the liner by a number of individual double adhesive strips, the liner occupies a minimum of space when folded together and shipped off to the point of use. Also, a liner with flexible corner bags according to the invention can be manufactured in a simple and inexpensive manner. The points of attachment can be chosen in accordance with the desired impact of the inflated bag on the corner region of the liner.

In a preferred embodiment, the inflatable bag comprises two essentially triangular or trapezoid, flexible sheets secured to each other in a gas-tight manner along the edges forming an interior space that can be increased in volume by inflation with pressurised air. Hereby, the manufacture of the flexible inflatable bags is simple and the production is easily altered to accommodate different sizes of bags. Moreover, the bags hardly occupy any space when deflated.

In the preferred embodiment, two flexible sheets are of an elastomeric material, preferably polyethylene, polypropylene or the like, said sheets being secured to each other by welding. The inflation tube comprises a first end that is preferably welded to the upper corner portion of the sheets forming the bag, said sheets being provided with a non-adhesive paper sheet prior to their assembly, such as a heat-transporting grease-proof paper sheet, said paper sheet being positioned in the opening of said first end of the inflation tube. The inflation tube is of a tubular plastic material or a similar or of somewhat lighter material than the sheet material of the bags. By this embodiment, the entire welding of the edges can be performed in a plane state and optionally also in a single operation depending on the welding equipment. The paper sheet at the end of the inflation tube prevents closure of the corner towards the interior of the bag. At the same time, the paper sheet only occupies an area inside the tube end. This ensures a gas-tight sealing of the corner region of the bag around the inflation tube. When initial pressurised air is advanced through the inflation tube, the small paper sheet is blown into the interior of the bag and is thus no obstacle to the inflation operation.

In a preferred embodiment, the sheets of the flexible bag are of a stronger sheet material than the sheet material of the liner. This is advantageous, in particular with the larger sized flexible inflation bags, as the bags are capable of resisting a large amount internal air pressure. It must be noted that by the term air pressure, it is realised by the invention that any other gas than air can be used for the inflation.

In a preferred embodiment of the invention, the flexible bag has a height of approx. 40 inches (100 cm), a width of about 44 inches (110 cm) and a length which is at least equal to the height, preferably at least two times the height, and between 80 to 120 inches (200 to 300 cm). A standardised bulk cargo container is 8 feet wide and when using two flexible inflation bags, an efficient funnel-like chute leading towards the discharge opening (which typically is about 12" in diameter) can be formed in the floor of the container. The length of the flexible bag can be regulated according to the characteristics of the product to be stored in the container liner and the discharge operation procedure. In particular, by regulating the length and maintaining the height on the flexible bag, the angle of the upper edge can be regulated. The preferred length depends on the tilting angle of the container and the angle of dip of the material. For some granular materials, this angle of "self-slide" is very low and for other granular materials, the angle is high. The steeper the angle the smaller the required relative difference between the height and the length of the flexible bag.

In the preferred embodiment of the invention, the displacement means comprise two inflatable, flexible bags at each lower corner region of the first end wall on each side of the discharge opening in order to create a funnel-like shape of the discharge region of the liner.

In one preferred embodiment, the triangular flexible bags are of the same size. This is particularly advantageous when the discharge opening is at the centre of the liner. In an alternative embodiment, the triangular flexible bags are of different sizes so that the flexible bag in the left corner region is larger than the right bag when viewed from the outside. The discharge opening is preferably set off from the centre line of the container liner and is advantageously placed in the right hand side, since it is usually the right-hand door of the two doors of a standard container that opens first. By using two inflatable bags of different sizes, a funnel-like shape can be provided for an off-set discharge opening. An off-set discharge opening can be advantageous, as the discharge of the contents of the liner is possible by opening the right-hand door only. In order to facilitate the discharge operation, the largest inflatable bag is provided with an inflation tube of approx. 30" (150 cm) in length. Hereby, the inflation tube of the left bag which is hidden behind the closed left-hand door is accessible and the left corner flexible bag can be inflated without having to open the left door.

BRIEF DESCRIPTION OF THE DRAWINGS

The invention is described in detail in the following with reference to the accompanying drawings, where.

DESCRIPTION OF THE DRAWINGS

Figure 1:
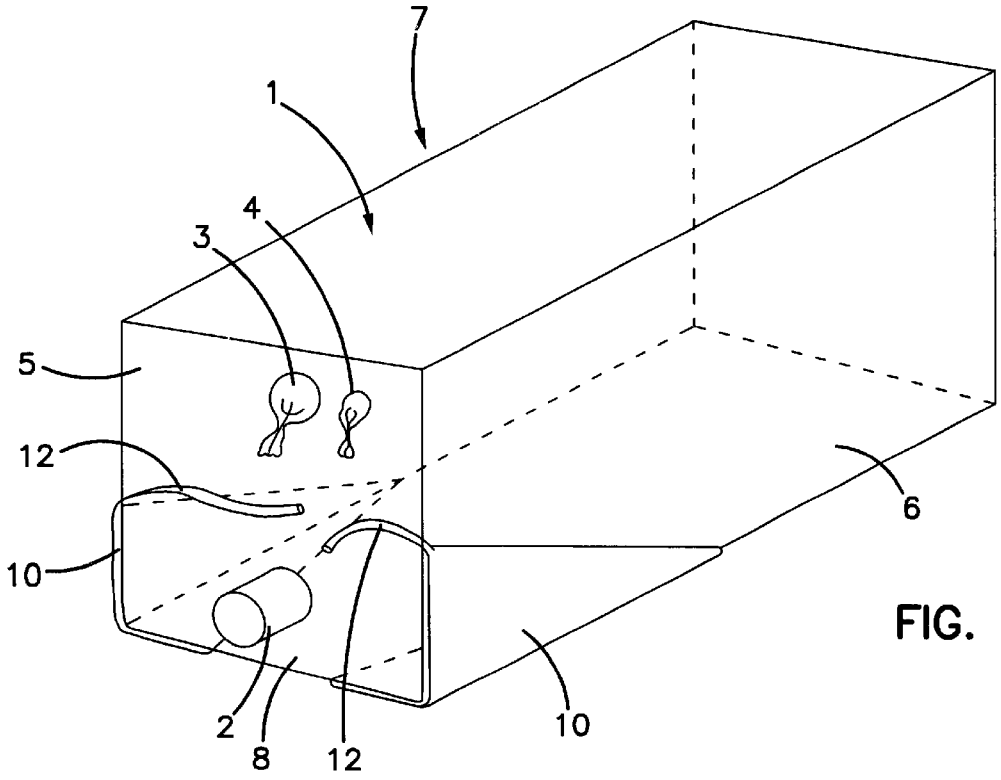
FIG. 1 is a schematic perspective view of a container liner fitted with two similar sized inflatable bags at the lower corners of the discharge end.

In FIG. 1, a container liner 1 is shown having a discharge opening 2 and two inlet openings 3 and 4 at the end wall 5. The container liner is box-like in shape having two side wall portions 6 and 7, a bottom wall portion, and a second end wall and a top wall portion in addition to the end wall 5.

At the lower corners of th discharge end 5, two flexible, inflatable bags 10 are provided. The bags are inflated by introducing pressurised air from a pressurised air source (not shown) into the interior of the bags through an inflation tube 12 fitted to each of the bags 10.

The container liner is designed for fitting on a bulk cargo container and is intended for use in relation to granular, powdered, pellet or other flowable products. For discharge of the container, the container is tilted at a certain discharge angle, e.g. up to 45° so that the discharge end 5 and particularly the discharge opening 2 is essentially the lower part of the container liner 1 and of the container. This causes the product inside the liner 1 to flow out of the discharge opening 2 under gravity. When the liner 1 is practically emptied, some of the material is typically left in the lower corner regions. These are gradually displaced by pushing this material sideways from the respective corners towards the discharge 2 by inflating the respective air bags 10.

The two bags 10 are of similar size and the discharge opening 2 is positioned in the centre of the container liner 1.

Figure 2:
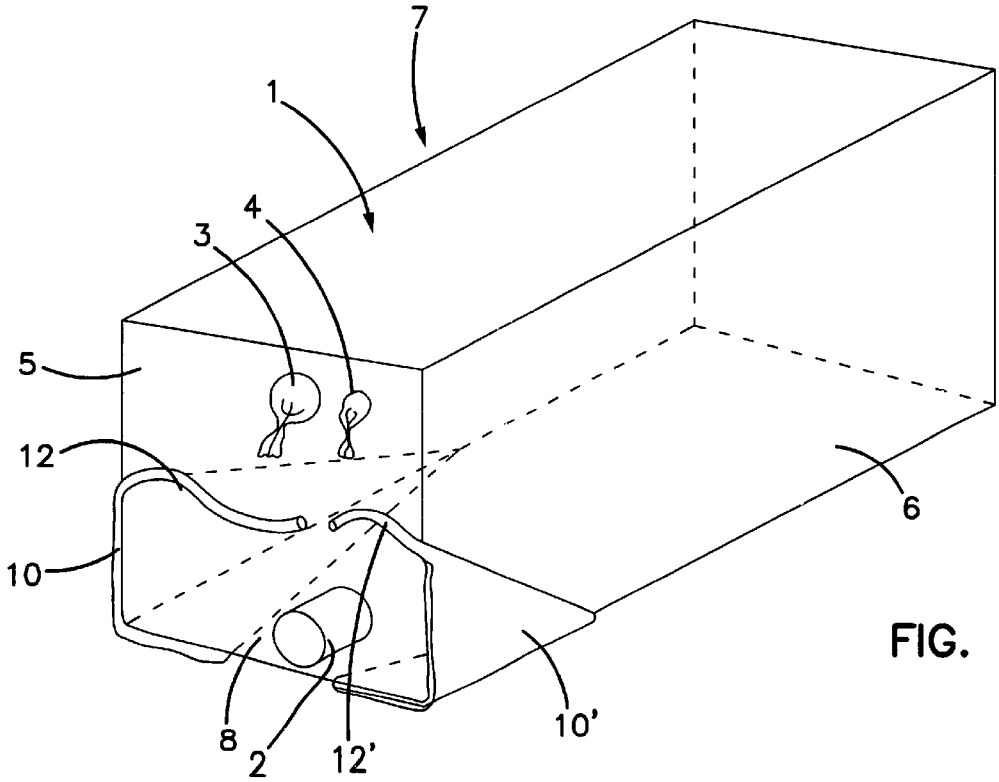
FIG. 2 is the same but with inflatable bags of different sizes.

In FIG. 2, a liner according to a second preferred embodiment of the invention is shown having two different sized inflatable air bags 10 and 10'. The two inflation tubes 12 and 12' are preferably also of different length.

Figure 3:
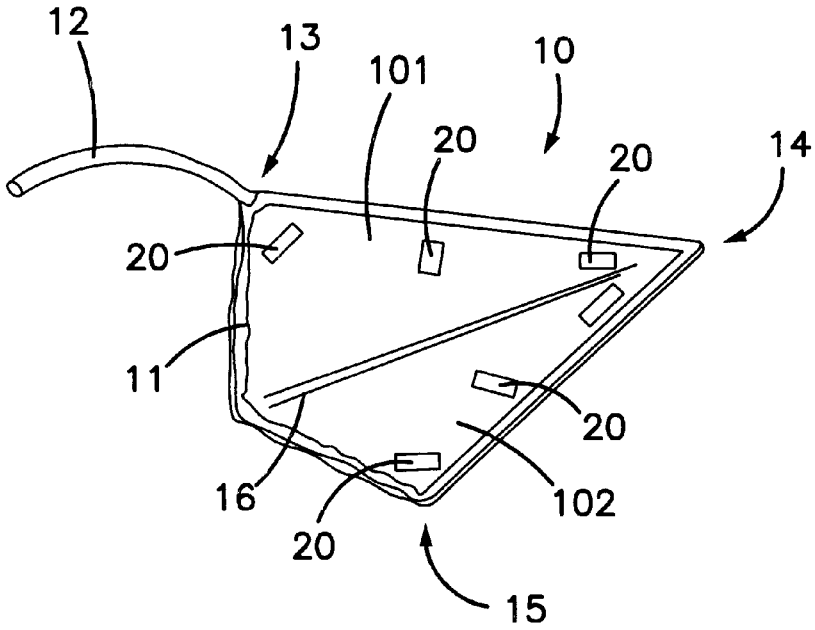
FIG. 3 is a perspective view of a flexible, inflatable bag in its deflated configuration when attached to the liner.
Figure 4:
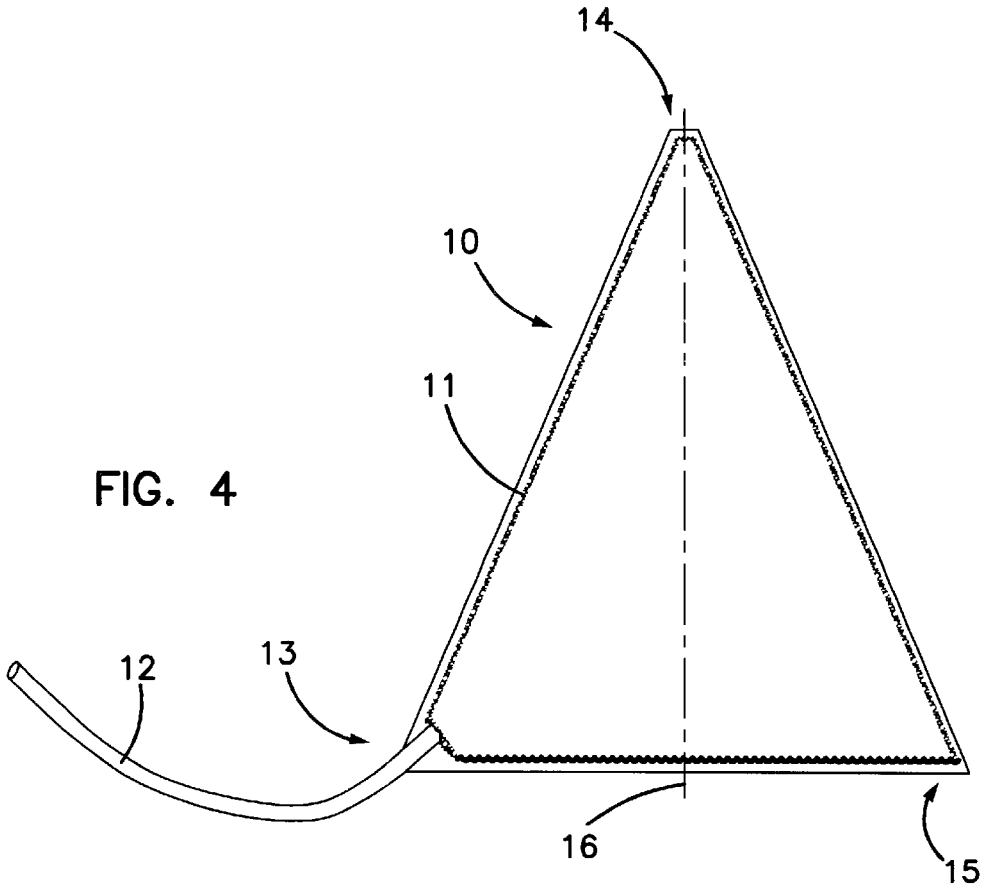
FIG. 4 is a schematic planar view of said inflatable bag.

The displacement means 10 is shown in its deflated configuration in FIGS. 3 and 4. The displacement means 10 is triangular in its deflated configuration having an essentially upright triangular portion 101 extending along the side wall portions 6 or 7 of the liner 1 and a second triangular portion extending along the floor portion 8 of the liner 1 (see FIG. 1 or 2). The flexible bag 10 has a first upper corner 13, a top second corner 14 and a third "floor" corner 15. It has a fold 16 that is substantively parallel with the side edge between the side and the floor wall portions 6, 7 and 8 with the liner 1 (see FIG. 1 and 2). The air bag is provided with a number of attachment points 20, preferably made of individual double adhesive strips of tape or the like.

Figure 5:
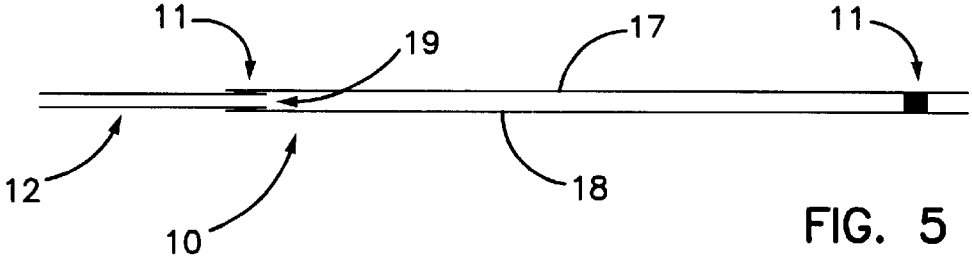
FIG. 5 is a cross-sectional view of same.

The air bag comprises two sheets of plastic material, such as polyethylene welded together along the edges whereby a welding seam 11 is provided around the edge portions of the triangular shaped bag 10. This construction is shown in a cross sectional view in FIG. 5. At the first corner 13, the inflation tube 12 is attached. Due to a previous insertion of a grease-proof paper sheet 19, the welding seam can be made without risking welding the end section of the tube 12 together. By the invention, it is of course realised that any kind of insertion sheet having non-adhesive properties and thus preventing closure of the tube end can be used. As shown in FIG. 5, the bag 10 is built of two flexible sheets 17 and 18. The welding seam 11 is provided with a gas-tight seal along the edge regions of said sheets 17 and 18. Since the paper sheet 19 is in fact lying loose in the tube end due to its non-sticky properties, the paper 19 is blown into the interior of the bag 10 when pressurised air is applied to the bag 10. This however, has no effect on the functionality of the bag 10.

Figure 6:
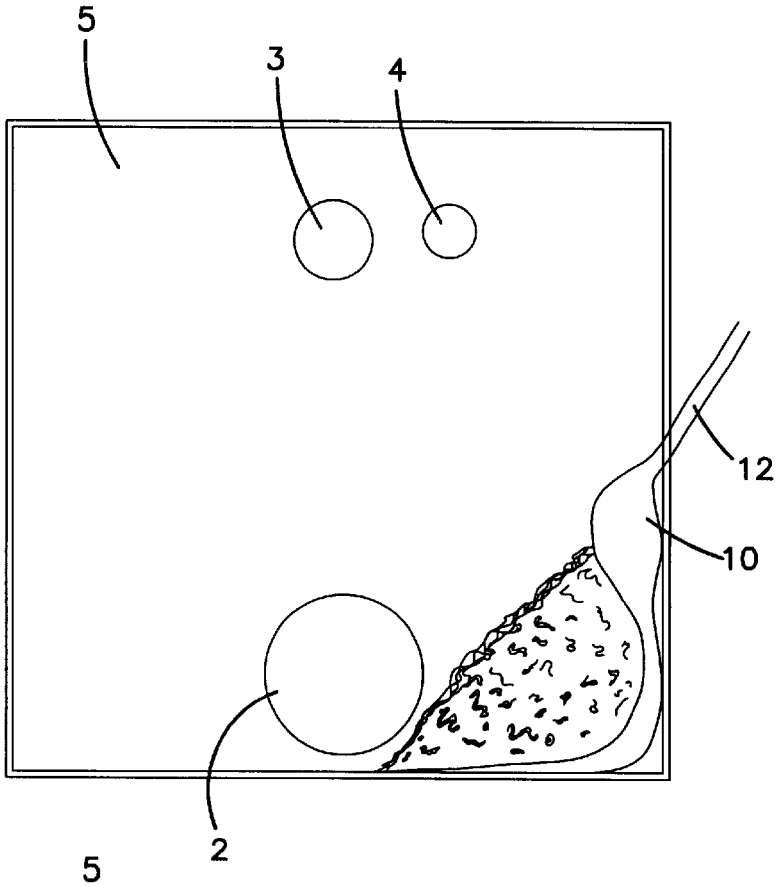
FIGS. 6 and 7 are schematic end views of a liner during the inflation of the flexible bags.
Figure 7:
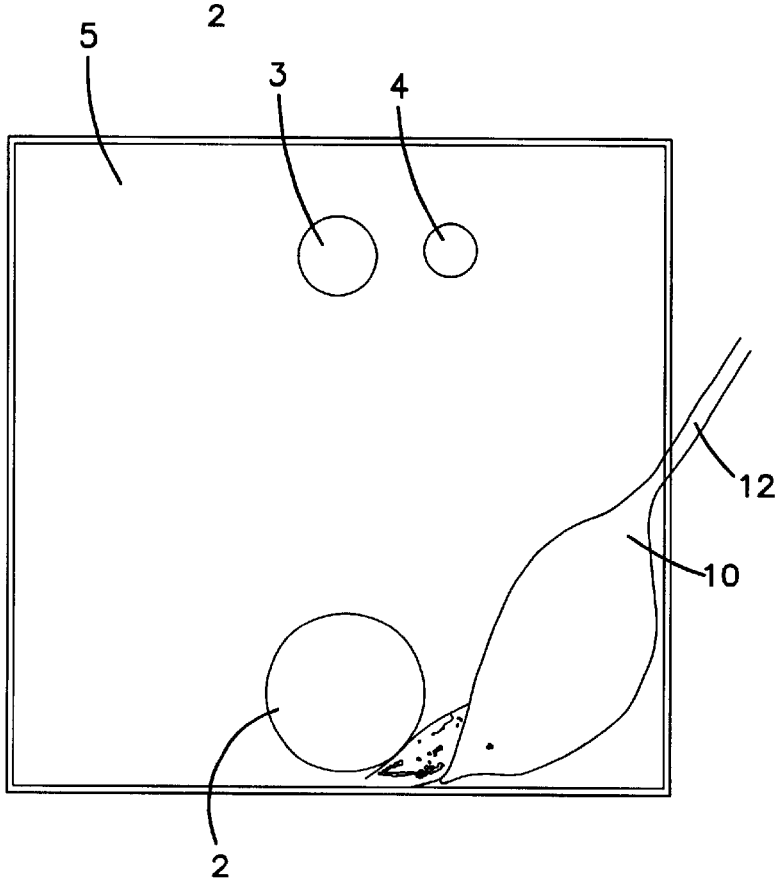

In FIGS. 6 and 7, the progression of the inflation of the bag 10 is shown. The flexible bag 10 is supplied with pressurised air trough the inflation tube 12 connected to the bag 10 at the upper corner 13 thereof. The bag is filled with air in the upper region since the material in the corner restricts a free flow of air inside the bag 10. As the bag 10 is inflated, the material is gradually pushed sideways towards the discharge 2. As the bag 10 is even more inflated, the amount of material is removed from the corner region, and the air flows more freely further downwards in the bag 10. In FIGS. 6 and 7, only one inflatable bag 10 is shown in order to show the principle of inflation. However, by the invention it is of course realised that two bags situated at each corner of the discharge end can advantageously be provided.

Figure 8:
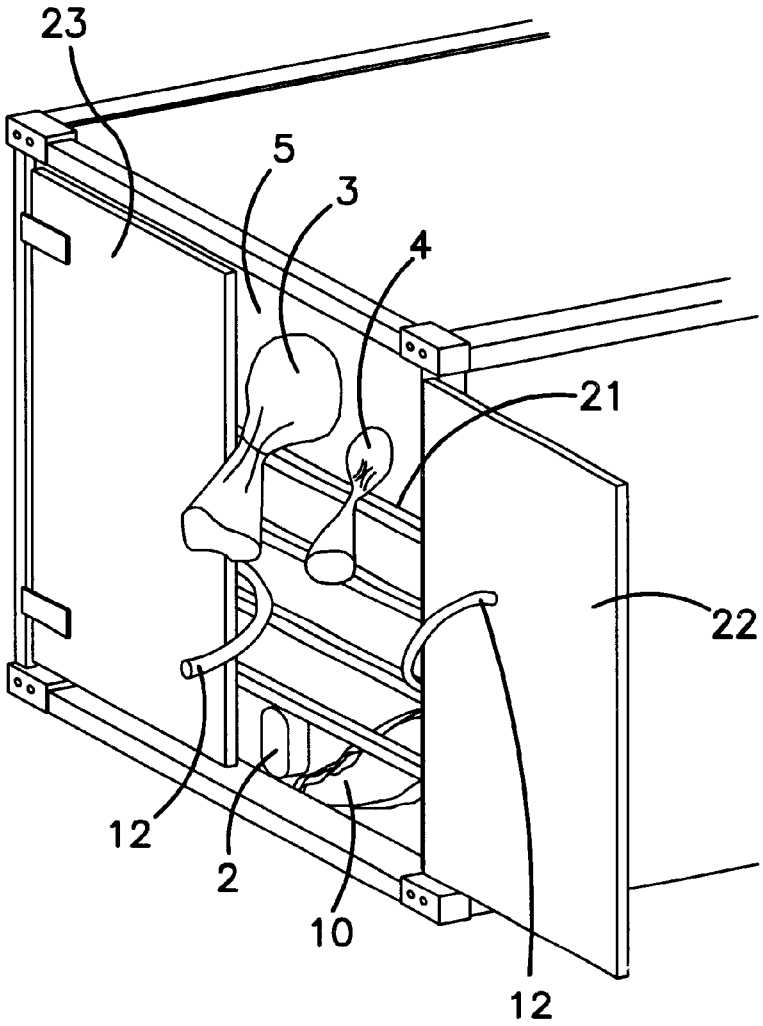
FIG. 8 is a schematic discharge end view of a container with a container liner according to the invention.

In FIG. 8, a container is shown during discharge. The container can be either a standard 20', 30' or 40' container, since width and height are usually standard measurements. The right hand door 22 of the standard container is opened, whilst the left-hand door remains closed. The discharge opening 2 of end 5 of the liner 1 is placed in the right-hand side of the container liner. The liner 1 is retained by a number of retention bars 21 forming part of the bulkhead. The bulkhead could further comprise a translucent curtain (not shown). This is advantageous, since it is possible to visually inspect and follow the process of the discharge operation. The retention bars 21 are suspended from the end side of the container opening.

As shown in FIG. 8, both the inflation tubes 12 are available through the right-hand door opening. The bag in the left corner remains behind the closed left door 23 but can nevertheless be inflated through the inflation tube 12. This left inflation tube 12 is longer than the inflation tube of the right inflation bag 10 so that it can easily be operated through the right door opening. As shown in the figure, the bag 10 at the right hand corner is inflated.

Figure 9:
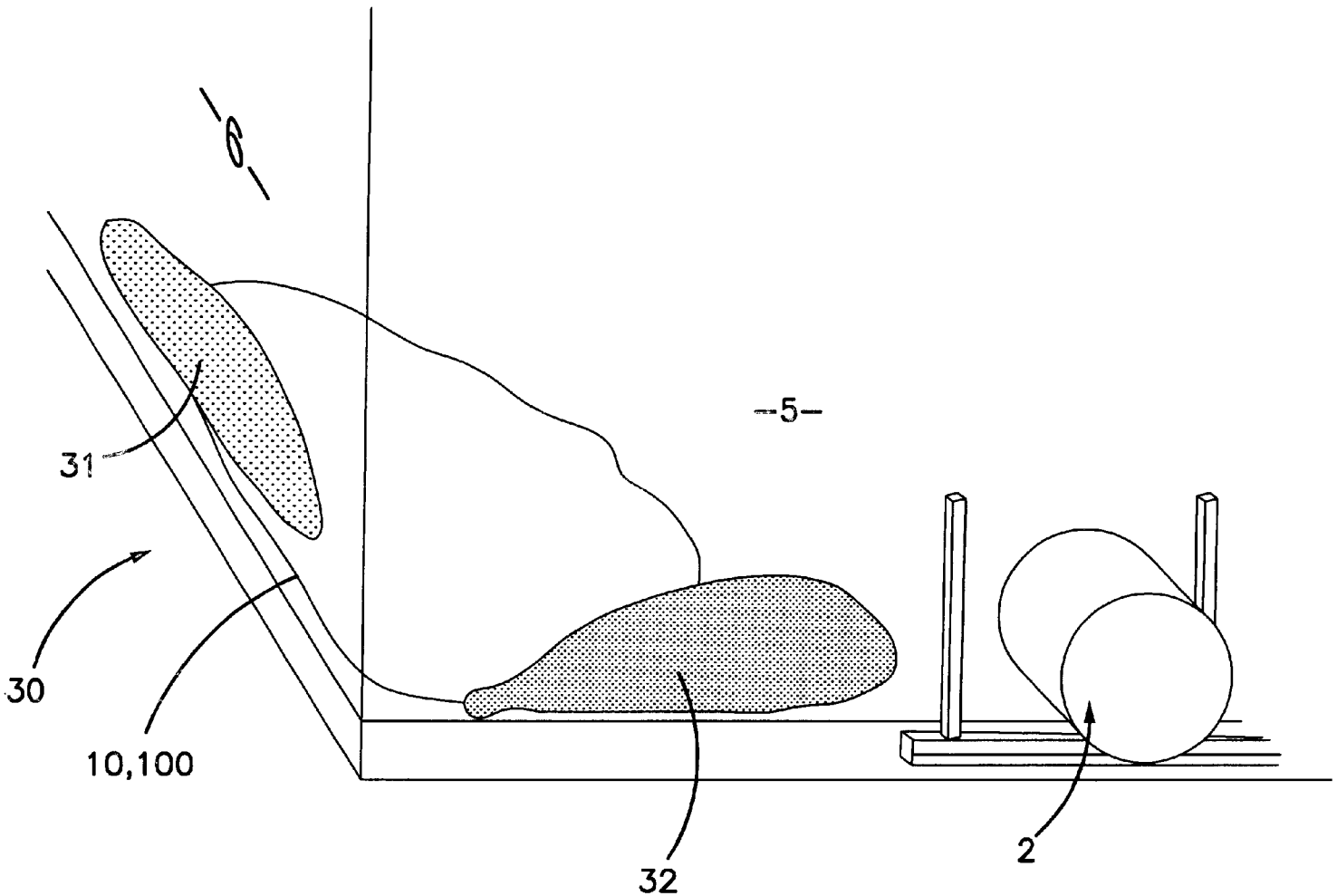
FIG. 9 is a schematic illustration of a section of a container.

In FIG. 9 a corner section 30 of a container is show. It is lined and the liner is provided with an inflatable bag 10 in the corner. As the bag 10 inflates, a small part of the granular material to be discharged can be trapped between the bag 10 and the side wall 6 or end wall 5 instead of sliding towards the outlet 2. The flexible liner is formed by the material and forms a pocket between the side/end wall 5, 6 and the inflated bag 10 that is rounded in shape when inflated. The zones where this material is most likely to be trapped are located as shown by the references 31 and 32 in FIG. 9.

Figure 10:
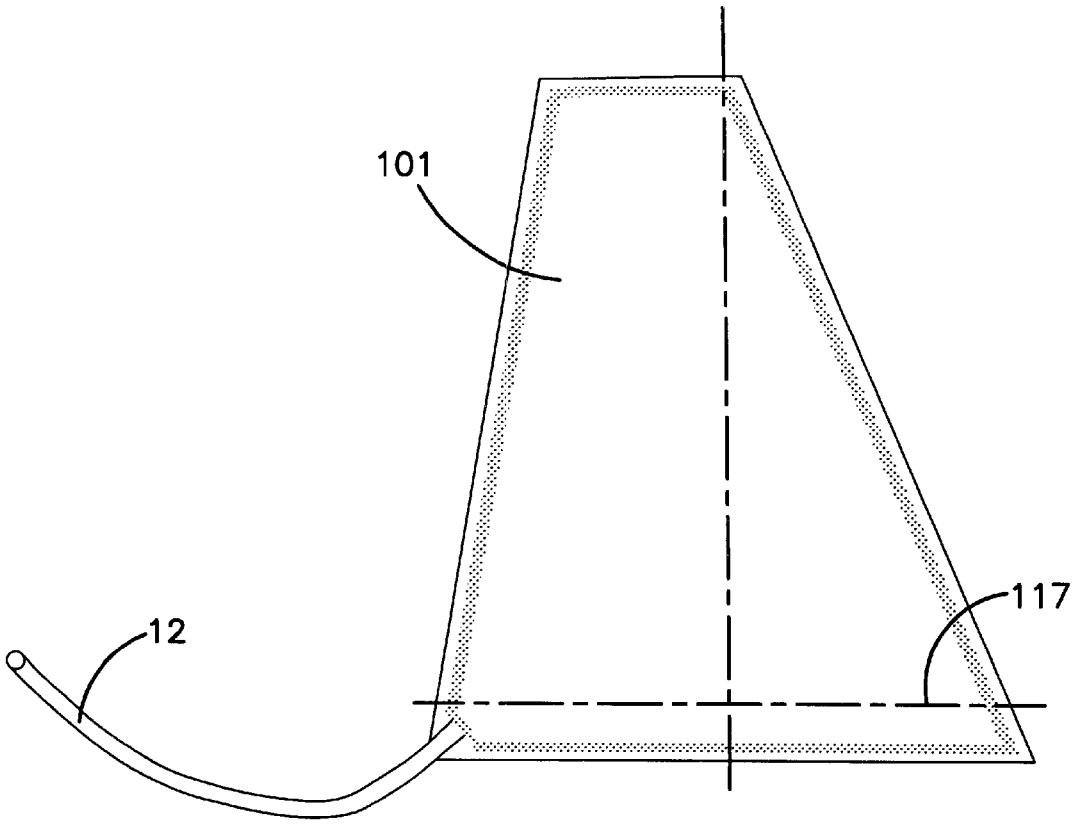
FIG. 10 is a schematic planar view of a second embodiment of an inflatable bag according to the invention.

The amount of material trapped can of course vary depending on the type of material, granular size etc. However, it is found that the phenomenon can be reduced or even eliminated by an inflatable bag 100 according to a second embodiment of the invention, such as shown in FIG. 10. Here, the "upright" portion 101 of the bag 100 is extended compared to the first embodiment of FIG. 4. This means that the air bag 100 will cause a displacement of the material towards the middle from a "higher" point, an push the material away from the side wall portion at an earlier stage in the discharge process and avoid material from forming a "pocket" in the container liner at the zone 31 of FIG. 9. Furthermore, the bag 100 is provided with an extension that can be folded about the fold line 117 so that a section of the inflatable bag 100 will refrain the material from forming a pocket in the zone 32 by the end wall 5.

Figure 11:
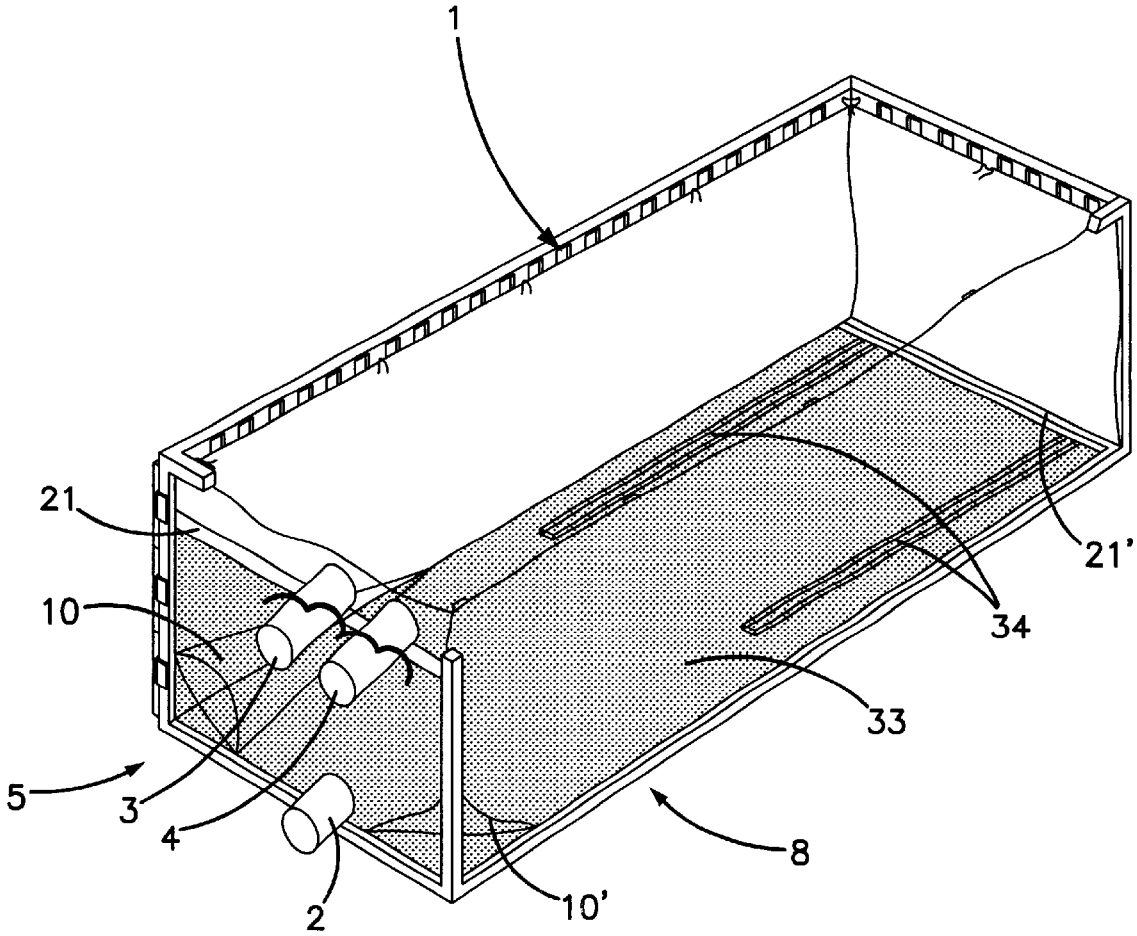
FIG. 11 is a perspective view of a container liner according to the invention with a flexible bulkhead mounted to a container.

As shown in FIG. 11, the container liner 1 may be accommodated by a flexible bulkhead 33 made of a sheet of foil or fabric. In a particular embodiment, the flexible bulkhead 33 is made of reinforced polypropylene, but other materials may also be used. The flexible bulkhead sheet 33 extends through at least the lower portion of the first end wall 5 and at least a substantial part of the bottom wall portion 8, preferably all the way to the edge between the floor and the second wall as shown in FIG. 11. The bulkhead sheet 33 has a first end that is secured to a traverse retention bar 21 positioned at the opening in front of the first end wall portion 5 of the liner 1. The second end of the flexible bulkhead 33 is secured to a traverse bar 21' at the edge region of the second end wall 6 and the bottom wall 8. In addition, the bulkhead sheet 33 may be secured to the floor of the container by double adhesive tape strips 34. Similarly, the bulkhead 33 may also be secured to the container liner 1 itself by additional double adhesive tape strips 34.

When the container liner is filled and/or when the material inside the container liner 1 gathers in the discharge region, the bulkhead sheet 33 is stretched. The flexible bulkhead sheet keeps the container liner and its contents from sliding out through the container opening. Hereby, the container liner 1, and in particular the air bags 10, 10', are kept from extending "outwards", i.e. through the container opening. In this way, it is ensured that the expansions of the air bags 10, 10' result almost entirely in traverse movements that, in turn, result in the displacement of the material inside the container liner 1 so the contents are directed towards the discharge opening 2. This flexible bulkhead 33 is particularly advantageous since it is light-weight. Moreover, a flexible bulkhead according to the invention is easy to handle and store. It can be folded or rolled up for storage so only a minimum amount of storage space is required.

The invention has been described with respect to some preferred embodiments thereof. However, it is understood by those skilled in the art that various changes may be made without departing from the scope of the invention. For instance, the flexible bag can be attached either to the inside or the outside of the liner. Accordingly, the invention is to be limited only as specified in the following claims.

What is claimed is:

1. A liner for use in a box-like cargo container for transportation of powder, granular or other flowable products, said liner comprising:

top and bottom walls, first and second side walls and first and second end wall portions;

a discharge opening at the lower portion of said first end wall through which the contents of the liner are discharged;

displacement means for guiding the contents towards said discharge opening;

said displacement means comprising an inflatable, flexible bag having an essentially triangular or trapezoid shape, wherein the inflatable bag comprises two essentially flexible sheets, said sheets being secured to each other in a gas-tight manner along their edges forming an interior space that can be increased in volume by inflation with pressurized air, said bag having a first edge substantively abutting said first end wall, and a first portion supporting the bottom wall and a second portion supporting an adjacent side wall portion of the liner;

said bag comprising three corners positioned substantively at the edge of the first end wall and the first side wall portion, the first end wall and the bottom wall portion, and the first side wall and the bottom wall portion, wherein the upper corner portion of the flexible bag is provided with a flexible inflation tube for inflation of the flexible bag with pressurized air causing the inflation to advance from the upper portion and downwards in the bag as the amount of material in the liner is reduced, wherein the flexible bag, when deflated, is folded against the bottom wall portion and the first or second side wall portion of the liner.

2. The liner of claim 1, wherein the second portion is triangular.

3. The liner of claim 1, wherein the second portion is trapezoid in shape.

4. The liner of claim 2, wherein the flexible bag is attached to an outside surface of the liner by a number of individual double adhesive strips.

5. The liner of claim 1, wherein the two flexible sheets are of an elastomeric material, said sheets being secured to each other by welding.

6. The liner of claim 1, wherein the inflation tube comprises a first end welded to an upper corner portion of the sheets for the bag and said sheets being provided with a non-adhesive paper sheet prior to assembly.

7. The liner of claim 1, wherein the inflation tube comprises a first end welded to an upper corner portion of the sheets forming the bag and said sheets being provided with a heat-transporting grease-proof paper sheet, said paper sheet being positioned in the opening of said first end of the inflation tube.

8. The liner of claim 1, wherein the sheets of the flexible bag are of a stronger sheet material than the sheet material of the liner.

9. The liner of claim 1, wherein the inflation tube has a minimum length of at least about 30 inches.

10. The liner of claim 1, wherein the flexible bag has a height of about 40 inches, a width of about 44 inches and a length which is at least equivalent to the height.

11. The liner of claim 10, wherein the length of the flexible, inflatable bag is chosen according to a specific self-slide characteristics of the material to be transported in the liner.

12. The liner of claim 1, wherein the displacement means comprises two inflatable, flexible bags at each lower corner region of the first end wall on each side of the discharge opening.

13. The liner of claim 12, wherein the triangular or trapezoid flexible bags are of similar size.

14. The liner of claim 12, wherein the triangular or trapezoid flexible bags are of different sizes so that the flexible bag in a first corner region is larger than the flexible bag positioned in a second corner region, said first corner region being the left hand bottom corner and the second corner region being the right-hand bottom corner region of the container opening end when viewed from this opening end.

15. The liner of claim 14, wherein the largest inflatable bag is provided with an inflation tube that is about 30 inches in length.

16. A transparent liner for use in a box-like cargo container for transportation of powder, granular or other flowable products, said liner comprising:

top and bottom walls, first and second side walls and first and second end wall portions;

a discharge opening at the lower portion of said first end wall through which the contents of the liner are discharged;

displacement means for guiding the contents of material towards said discharge opening;

said displacement means comprising an inflatable, flexible bag having an essentially triangular or trapezoid shape, wherein the inflatable bag comprises two essentially flexible sheets, said sheets being secured to each other in a gas-tight manner along their edges forming an interior space that can be increased in volume by inflation with pressurized air, said bag having a first edge substantively abutting said first end wall, and a first portion supporting the bottom wall and a second portion supporting an adjacent side wall portion of the liner;

said bag comprising a first upper corner positioned substantively at an edge of the first end wall and the first side wall portion, a second corner at an edge region of the first end wall and the bottom wall portion, and a third corner at an edge region of the first side wall and the bottom wall portion;

a flexible inflation tube provided at the first, uppermost corner portion of the flexible bag for inflation of the flexible bag with pressurized air causing the inflation to advance from the upper portion and downwards in the bag as the amount of material in the liner is reduced; and a bulkhead comprising a translucent curtain and a number of generally horizontal transverse retention bars secured to the container, wherein the flexible bag, when deflated, is folded against the bottom wall portion and the first or second side wall portion of the liner.

17. A bulkhead for a liner for use in a box-like cargo container for transportation of powder, granular or other flowable products, said liner comprising:

top and bottom walls, first and second side walls and first and second end wall portions;

a discharge opening at the lower portion of said fist end wall through which the contents of the liner are discharged;

displacement means for guiding the contents towards said discharge opening;

said displacement means comprising at least one inflatable, flexible bag having an essentially triangular or trapezoid shape substantively abutting said first end wall, and a first essentially triangular portion supporting the bottom wall and a second portion supporting an adjacent side wall portion of the liner;

said bag comprising three corners positioned substantively at the edge of the first end wall and the first side wall portion, the first end wall and the bottom wall portion, and tile first side wall and the bottom wall portion;

the bulkhead being a flexible sheet of foil or fabric, said flexible sheet extending through at least the lower portion of the first end wall and at least a substantial part of the bottom wall portion, said flexible sheet having a first end that is secured to a transverse retention bar at the first end wall portion and a second end that is secured to a transverse bar at the second end wall or the bottom wall.

* * * * *